US007607251B2

(12) United States Patent
Kim et al.

(10) Patent No.: US 7,607,251 B2
(45) Date of Patent: Oct. 27, 2009

(54) AIR CONDITIONER

(75) Inventors: Ji Hoon Kim, Jinhae-si (KR); Joong Gil Yoo, Seongnam-si (KR); Ki Jung Yoo, Seoul (KR); Hee Jae Kwon, Seoul (KR); Kam Gyu Lee, Pusan-si (KR); In Hee Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 507 days.

(21) Appl. No.: 11/326,396

(22) Filed: Jan. 6, 2006

(65) Prior Publication Data

US 2006/0162212 A1 Jul. 27, 2006

(30) Foreign Application Priority Data

Jan. 26, 2005 (KR) ..... 10-2005-0007164
Jan. 26, 2005 (KR) ..... 10-2005-0007165

(51) Int. Cl.
*A47G 1/06* (2006.01)

(52) U.S. Cl. ..... 40/725; 40/724; 40/711; 62/263

(58) Field of Classification Search ..... 40/724, 40/725, 711; 62/263; 312/348.4
See application file for complete search history.

(56) References Cited

U.S. PATENT DOCUMENTS 4,583,309 A * 4/1986 Kane et al. ..... 40/711
4,733,542 A * 3/1988 Blair ..... 62/263
5,373,654 A * 12/1994 Whalen ..... 40/716
5,987,908 A * 11/1999 Wetzel ..... 62/259.1
6,018,955 A * 2/2000 Kaneko et al. ..... 62/125
6,209,248 B1 * 4/2001 Reinhard ..... 40/768
6,487,802 B2 * 12/2002 Suen ..... 40/542
2002/0189274 A1 * 12/2002 Lee et al. ..... 62/298
2003/0145618 A1 8/2003 Moon et al.

FOREIGN PATENT DOCUMENTS

EP 1 271 065 A2 1/2003
FR 2846487 A1 * 4/2004
JP 03213921 A * 9/1991
JP 8-285318 A 11/1996
KR 10-2002-0033880 5/2002
KR 10-2005-0024798 3/2005
WO WO-03/014628 A2 2/2003

* cited by examiner

*Primary Examiner*—Gary C Hoge
(74) *Attorney, Agent, or Firm*—Birch, Stewart, Kolasch & Birch, LLP

(57) ABSTRACT

There is provided an air conditioner. In the air conditioner, a front panel is installed to a front of a main body, a front cover is disposed at a front of the front panel and detachably coupled to the main body, and an art panel is interchangeably inserted in the front cover.

19 Claims, 8 Drawing Sheets

AIR CONDITIONER

BACKGROUND OF THE INVENTION

1. Field of the Invention

The present invention relates to an air conditioner, and more particularly, to an indoor unit of an air conditioner for allowing pictures or photographs displayed by the front thereof to be easily interchanged, thus providing the functional benefits of an air conditioner with an added aesthetic factor of interior decoration.

2. Description of the Related Art

Refrigerants circulating inside air conditioners undergo compression, condensing, expansion, and evaporation stages of a refrigeration cycle. In an air conditioner, refrigerant is first compressed to become high in temperature and pressure, and loses heat to the outside in a condenser, after which it passes through an expansion valve, gradually cooling and depressurizing. The cooled and depressurized refrigerant flows through an evaporator, absorbing heat along the way, and is then recycled to the compressor.

Here, the compression, condensing, and expansion stages occur in an outdoor unit of an air conditioner; and the evaporation stage occurs in an indoor unit by virtue of a blower fan and a heat exchanger. Air conditioners are grouped into two basic types: single unit air conditioners that consist of a single unit which performs the entire refrigeration cycle, installed in a wall opening such as a window, and split system air conditioners that have a separate indoor and outdoor unit that are respectively installed indoors and outdoors.

Split systems are further divided into wall mounted, permanently-installed, ceiling mounted, and ceiling concealed air conditioners. Convertible type air conditioners have versatile indoor units, which can be wall mounted, permanently-installed, or even ceiling mounted. Air conditioner indoor units come in various configurations, depending on the arrangement of their intake and discharge vents. For example, an indoor unit that intakes air from its sides and expels air from its front has discharge louvers disposed at the front to pivot up and down or from side to side for directing air accordingly.

Such prior art air conditioner indoor units have front portions that function only as covers. That is, a front cover installed at the front of an indoor unit functions to prevent components, such as a blower fan, heat exchanger, etc., from being exposed to the outside, as well as preventing electrocution or injury of children who may otherwise stick their hands inside the unit. Accordingly, the front of an indoor unit has a monotonous and stoic feel, and does not harmonize well with an interior.

SUMMARY OF THE INVENTION

Accordingly, the present invention is directed to an air conditioner that substantially obviates one or more problems due to limitations and disadvantages of the related art.

An object of the present invention is to provide an air conditioner indoor unit with a structure that allows easy installation and removal of pictures or photographs to and from its blank front cover, so that the unit fulfills its air conditioning duties, as well as complements the decor of an interior space.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an air conditioner according to the present invention includes: a main body; a front panel installed at the front of the main body; a cover disposed at the front of the front panel, and detachably coupled to the main body; and an art panel interchangeably inserted in the cover.

According to another aspect of the present invention, there is provided an air conditioner including: a main body; a back cover disposed at the front of the main body; a window made of transparent material disposed in front of the back cover; an art panel interposed between the back cover and the window; and a side frame forming an enclosure for. the edges of the back cover, window, and art panel.

According to a further aspect of the present invention, there is provided an air conditioner including: a main body; a panel moveably attached to the front of the main body; and a cover for interchangeably holding pictures or photographs and detachably mounted on the front of the panel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, preferred embodiments of an air conditioner according to the present invention will be described in detail with reference to the accompanying drawings. While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

Figure 1:
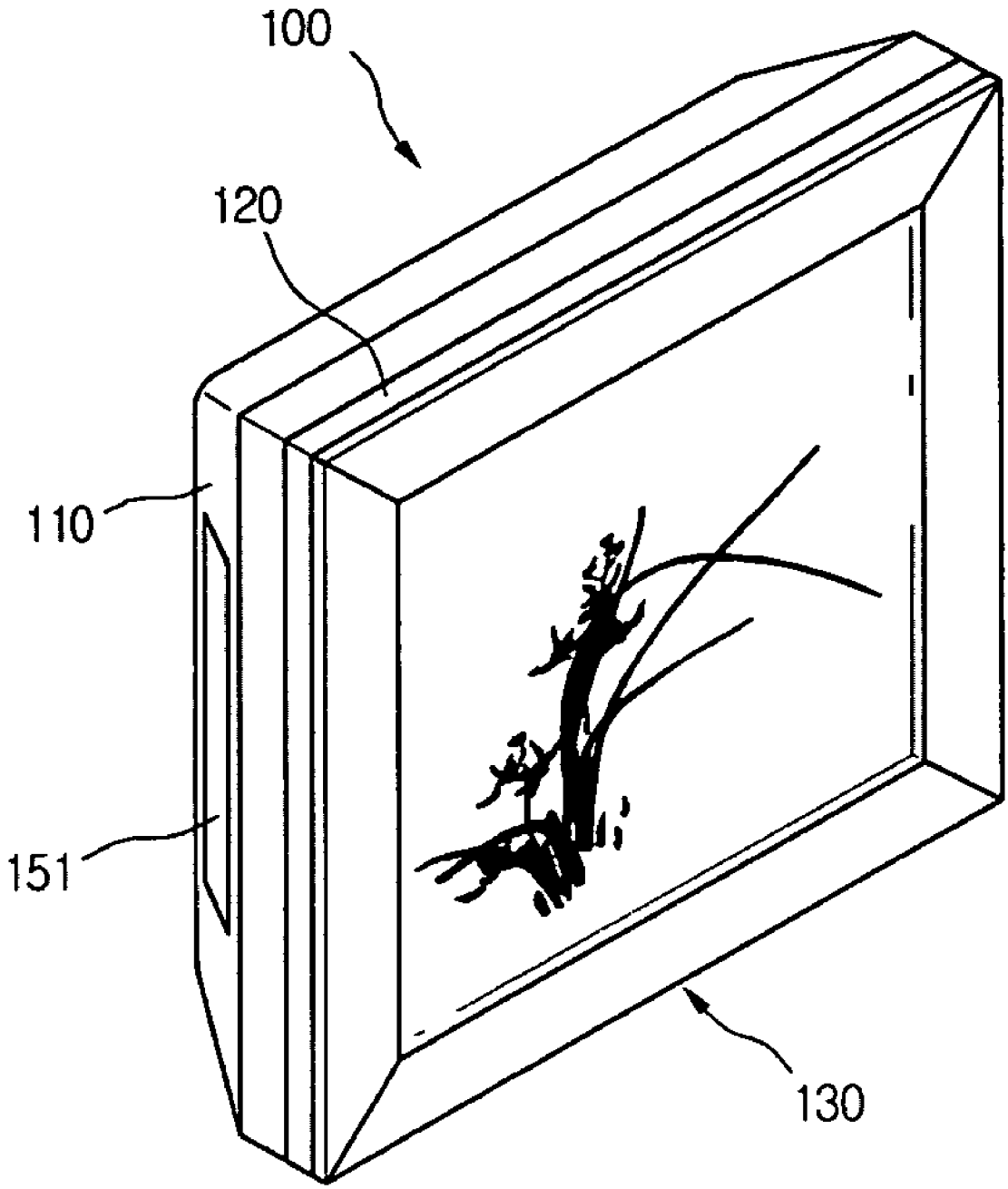
FIG. 1 is a perspective view of an indoor unit of an air conditioner according to the present invention.
Figure 2:
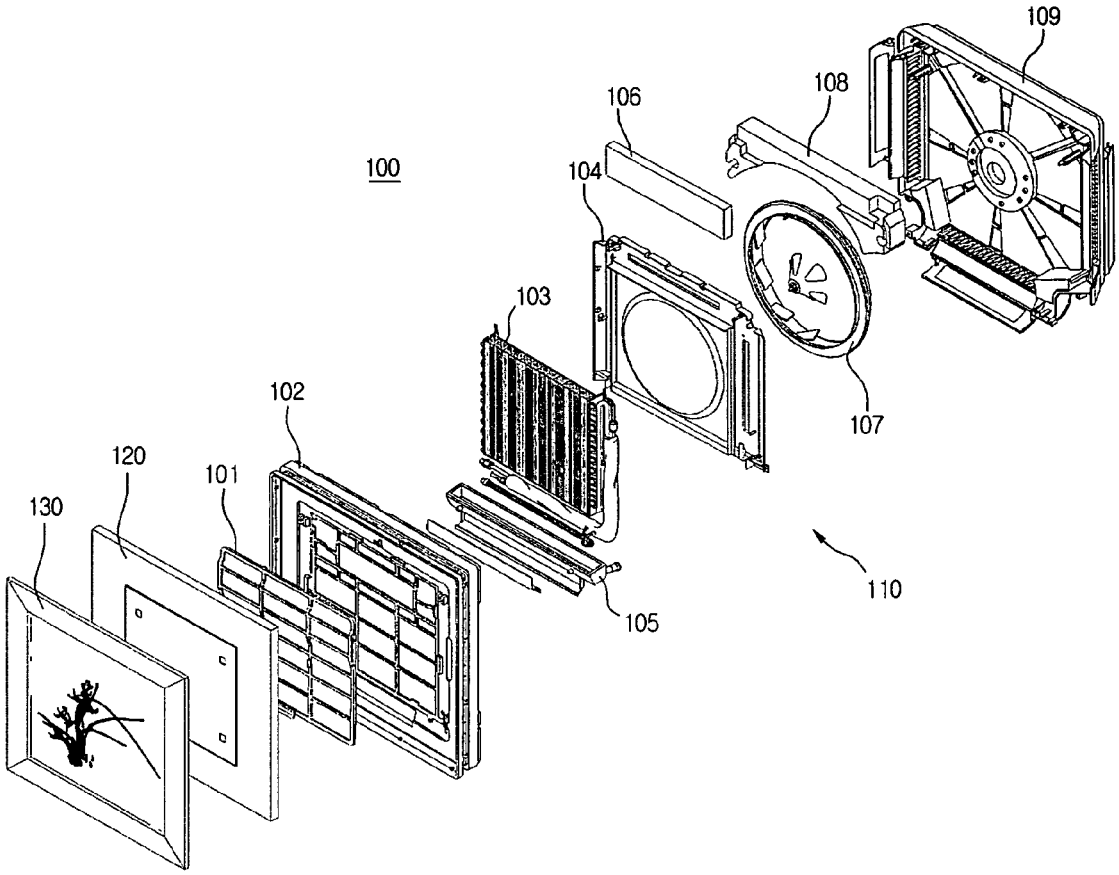
FIG. 2 is an exploded view of the indoor unit in FIG. 1.

FIG. 1 is a perspective view of an indoor unit of an air conditioner according to the present invention, and FIG. 2 is an exploded view of the thereof.

Referring to FIGS. 1 and 2, the indoor unit 100 of the air conditioner according to the present invention includes a main body 110 forming the exterior of the unit, a front panel 120 disposed at the front of the main body 110 to pivot a predetermined angle by means of a hinge, and a front cover 130 detachably coupled to the front of the front panel 120 for having a picture or photograph inserted therein.

An intake opening 150 (refer to FIG. 4) for suctioning indoor air is formed when the front panel 120 pivots on a hinge to open at a predetermined angle on one side. The indoor air that enters the intake opening 150 is discharged from the discharge vent 151 formed on a side of the main body 110.

The main body 110 further includes a filter 101 for filtering impurities from the indoor air, a front frame 102 disposed behind the filter 101 for installing the filter thereon and protecting the components therein, a base 109 coupled to the front frame 102, and a blower fan 107 installed between the front frame 102 and the base 109 for drawing indoor air into the unit.

Additionally, the main body 110 includes a heat exchanger 103 installed in front of the blower pan 107 for lowering the temperature of indoor air drawn into the unit, a drain fan 105 disposed below the heat exchanger 103 for collecting moisture that condenses on and drips from the heat exchanger 103, an air guide 104 installed behind the heat exchanger 103 for directing the flow of indoor air drawn into the unit, an electronics housing 106 disposed above the air guide 104 for housing electronic components, and a guide duct 108 for causing indoor air drawn into the unit by the blower fan 107 to be discharged from the unit.

An explanation of the operation and function of the indoor unit 100 of an air conditioner according to the present invention will now be set forth.

First, when electrical current is applied to the indoor unit 100, the front panel 120 disposed at the front of the main body 110 pivots to open at a predetermined angle, creating an intake opening 150.

At the same time that the front panel 120 moves to create an intake opening 150, the blower fan 107 inside the main body 110 begins spinning. The spinning blower fan 107 draws indoor air through the intake opening 150 into the unit. The drawn air sheds its impurities as it passes through the filter 101, and proceeds through the heat exchanger 103 to exchange heat with refrigerant therein. When the air passes through the heat exchanger 103, its temperature drops, and it is then directed via the air guide 104 towards the blower fan 107. The air is then guided by the guide duct 108 disposed above the blower fan 107 so that it is finally discharged through the discharge vent 151 back to the indoor space.

As explained above, the front panel 120 disposed on the front of the main body 110 and the front cover 130 disposed at the front of the front panel 120 are detachably coupled to one another.

Figure 3:
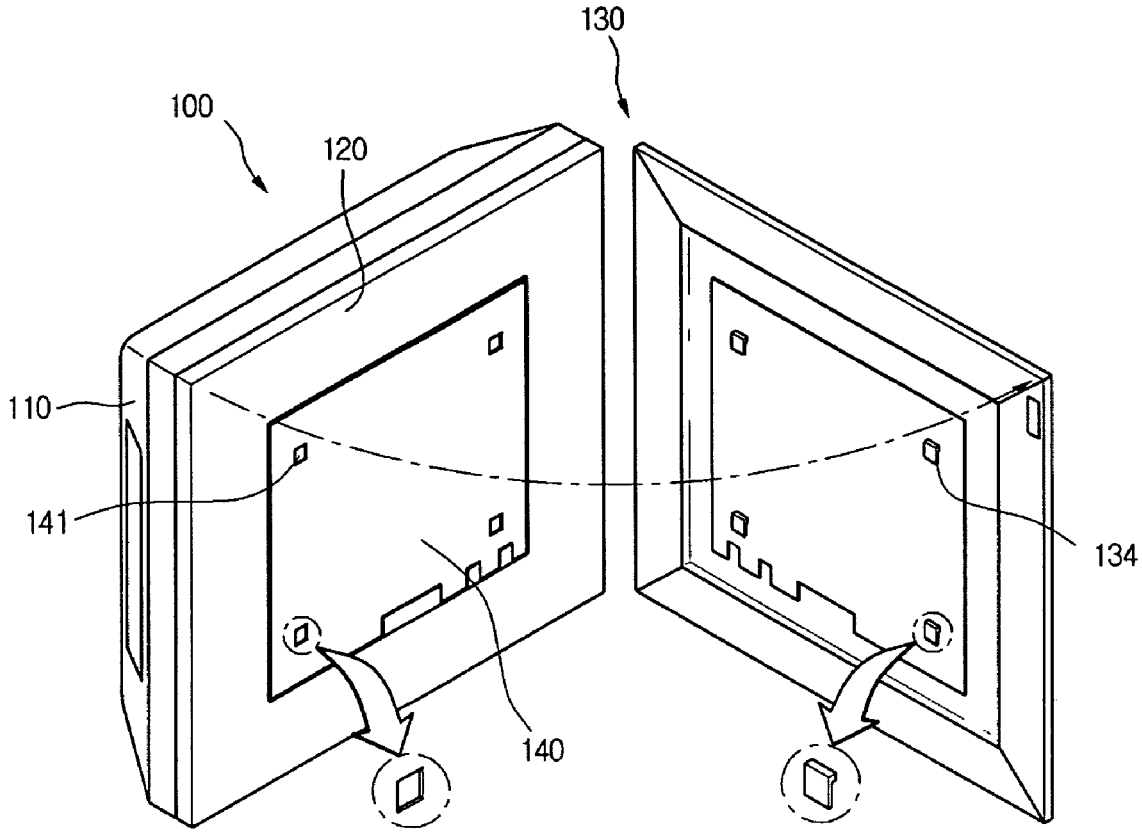
FIG. 3 is a disassembled view of the front cover of the indoor unit of an air conditioner according to the present invention.
Figure 4:
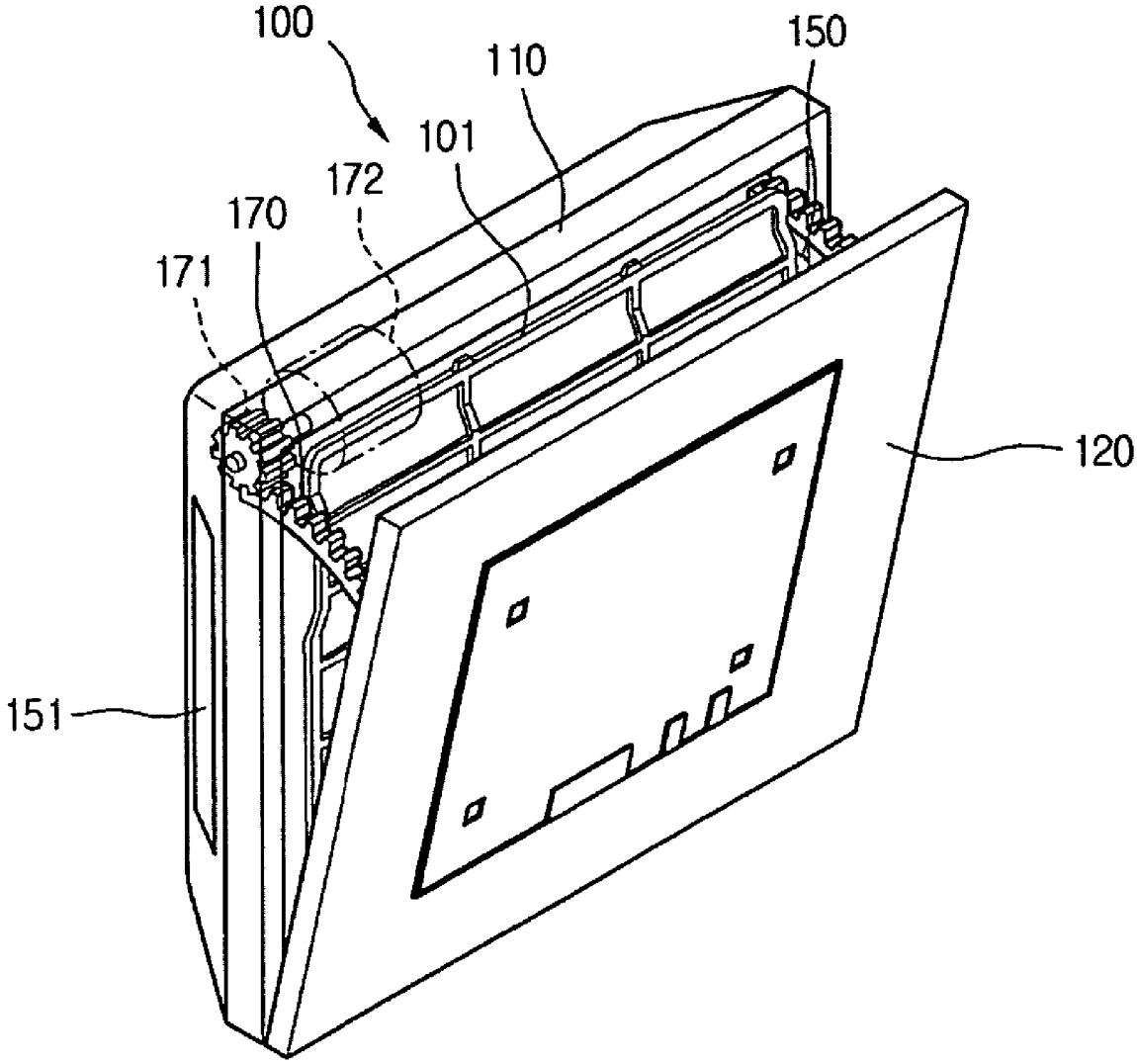
FIG. 4 is a perspective view of an indoor unit of an air conditioner showing an air intake structure according to one embodiment of the present invention.

FIG. 3 is a disassembled view of the front cover of the indoor unit of an air conditioner according to the present invention, and FIG. 4 is a perspective view of an indoor unit of an air conditioner showing an air intake structure according to one embodiment of the present invention.

Referring to FIGS. 3 and 4, the indoor unit 100 of the air conditioner according to the present invention includes a front cover 130 detachably coupled to the main body 110, and a front panel 120 having the front cover 130 attached to its front and being attached on the main body 110 to pivot a predetermined angle. At least one mounting hook 134 is formed at the rear of the front cover 130 for attaching the same to the front panel 120. Conversely, an eyelet 141 is formed on the front of the front panel 120 for coupling with the mounting hook 134. Here, the mounting hook 134 may take the form of a hook, and the eyelet 141 may be a hole of a predetermined size for accommodating the insertion of the mounting hook 134 therein. However, the mounting device is not necessarily limited to the mounting hook and eyelet embodiment of the present invention, and can include magnets or other detachably mountable devices.

The pivoting direction of the front panel 120 is also not necessarily limited to the previously-described embodiment, and thus the pivot axis can be disposed at any one of the top, bottom, right, and left edges of the indoor unit. The pivot axis may be designated as the bottom edge, so that when the front panel 120 is activated to pivot forward therefrom forming an intake opening, the image installed at the front of the unit can still be viewed.

As shown in FIG. 4, when the indoor unit operates, the front panel 120 has one of its edges designated as a pivot axis, while the other end swings forward at a predetermined angle, thereby forming an intake opening 150 between the front panel 120 and the front cover 130. In order to allow the front panel 120 to swing forward from the main body 110, a rack 170 is formed to extend a predetermined distance from the rear of the front panel 120, the rack 170 having gear teeth on a side thereof. Here, in order to smoothly open the front panel 120, the rack 170 has the same curvature as an arc formed by the front panel 120 swinging open. The main body 110 contains a rotating pinion 171 that has teeth meshing with those of the rack 170, and a step motor 172 rotating the pinion 171 in a forward and reverse direction. When an electrical current is applied to the indoor unit 100, the step motor 172 rotates the pinion 171. The rack 170 meshed with the pinion 171 moves to pivot the front panel 120.

Figure 5:
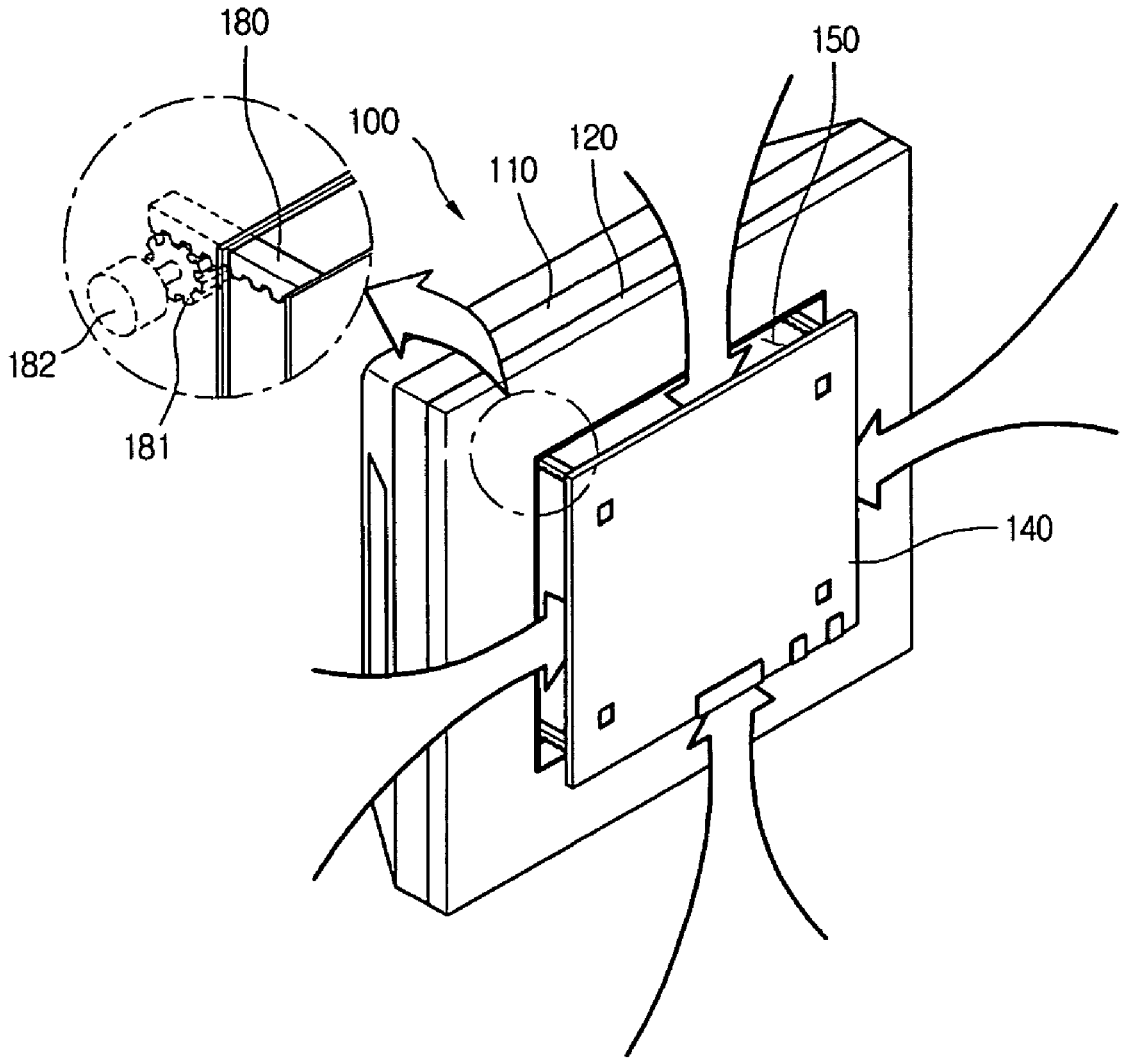
FIG. 5 is a perspective view of an indoor unit of an air conditioner showing an air intake structure according to another embodiment of the present invention.

FIG. 5 is a perspective view of an indoor unit of an air conditioner showing an air intake structure according to another embodiment of the present invention.

Referring to FIG. 5, the indoor unit 100 of the air conditioner according to the present invention includes a main body 110, a front panel 120 installed at the front of the main body, and a sub panel 140 of a predetermined size formed inside the front panel 120, and capable of forward and backward translation movement.

To elaborate, in order to allow the sub panel 140 to translate forward and backward with respect to the front panel 120, a rack 180 having gear teeth on one side thereof extends a predetermined distance from the back of the sub panel 140. Installed inside the main body 110 are a rotating pinion 181 meshing with the teeth of the rack 180, and a step motor 182 rotating the pinion 181 in a forward and reverse direction. Here, in order to allow forward and backward translation of the sub panel 140, the rack 180 may be straightly formed. Also, in order to allow uniform forward and backward translation of the sub panel 140, a rack is formed on each of the four corners at the rear of the sub panel 140.

In addition to the above embodiment where the sub panel 140 is capable of translation, the sub panel 140 can be formed as one with the front panel 120, or the front panel 120 can be made capable of forward and backward translation.

Figure 6:
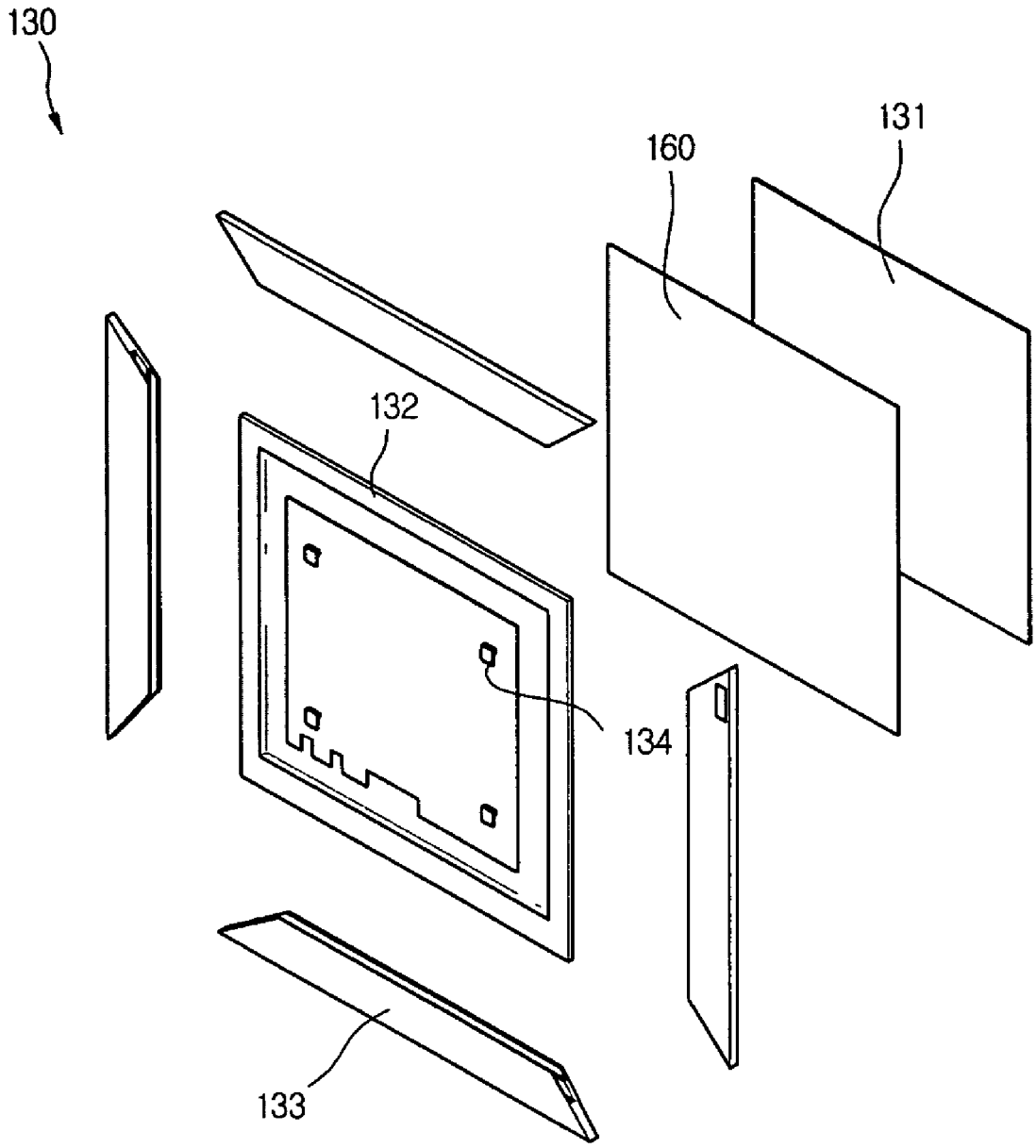
FIG. 6 is an exploded perspective view of the front cover of the indoor unit of an air conditioner according to the present invention.
Figure 7:
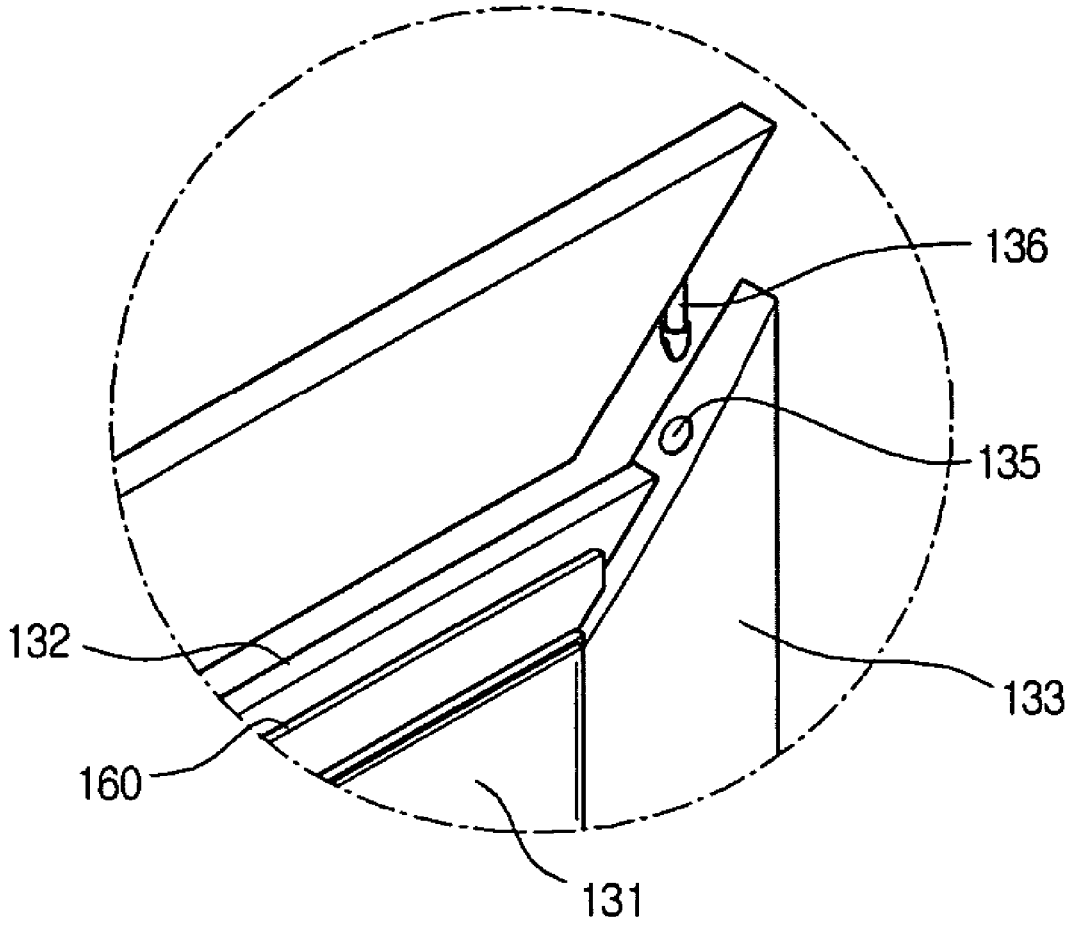
FIG. 7 is an enlarged perspective view showing the assembly of the front cover frame edges of the air conditioner indoor unit according to the present invention.

FIG. 6 is an exploded perspective view of the front cover of the indoor unit of an air conditioner according to the present invention, and FIG. 7 is an enlarged perspective view showing the assembly of the front cover frame edges of the air conditioner indoor unit according to the present invention.

Referring to FIGS. 6 and 7, the front cover 130 according to the present invention includes an art panel 160, a cover plate, and a frame edge 133. The art panel 160 holds a picture or photograph. The cover plate includes a back plate 132 having a front surface on which the art panel 160 is mounted and a window 131 made of transparent material for covering the front of the art panel 160 so that dust and other foreign substances do not adhere to the art panel 160. The frame edge 133 holds the back plate 132, the art panel 160, and the window 131 together so that they do not separate.

In further detail, the frame edge 133 is installed on each of the four edges of the front cover 130, and is connected by means of connectors disposed on the end portions thereof. In order to mount the art panel 160, the front of the back plate 132 may have a mounting surface recessed a predetermined depth. The edges of the back plate 132 and the window 131 can be received in a groove recessed a predetermined depth in the frame edge 133, to assemble the components. The frame edge 133 that is assembled at the top, bottom, and on both sides, has a connector on either end thereof that allows detachable assembly.

In still further detail, a connecting member 136 is disposed on one or both ends of the frame edge 133. A connecting hole 135 is formed for inserting the connecting member 136 therein, so that an end of one frame edge 133 can be coupled with an end of another frame edge 133. Four frame edges 133 can be connected to form one frame by means of the connecting members 136 and the opposing connecting holes 135. Here, the connecting member 136 may be formed as a hooked member so that it can be effectively coupled to and removed from the connecting hole 135. However, the connector disposed on each end of the frame edge 133 does not necessarily have to be formed as a hook, and can be formed of a magnetic material to allow two frame edges to be coupled magnetically. Also, a separate corner piece can be inserted over the perpendicularly connecting junction of two frame edges 133 to couple the two pieces together. That is to say, the present invention encompasses a variety of methods that can be used to couple the frame edges 133 together.

In addition, a groove for inserting the window 131, art panel 160, and the back plate 132 therein is recessed a predetermined depth and formed along the inside of the frame edge 133 from one end to the other end thereof.

Figure 8:
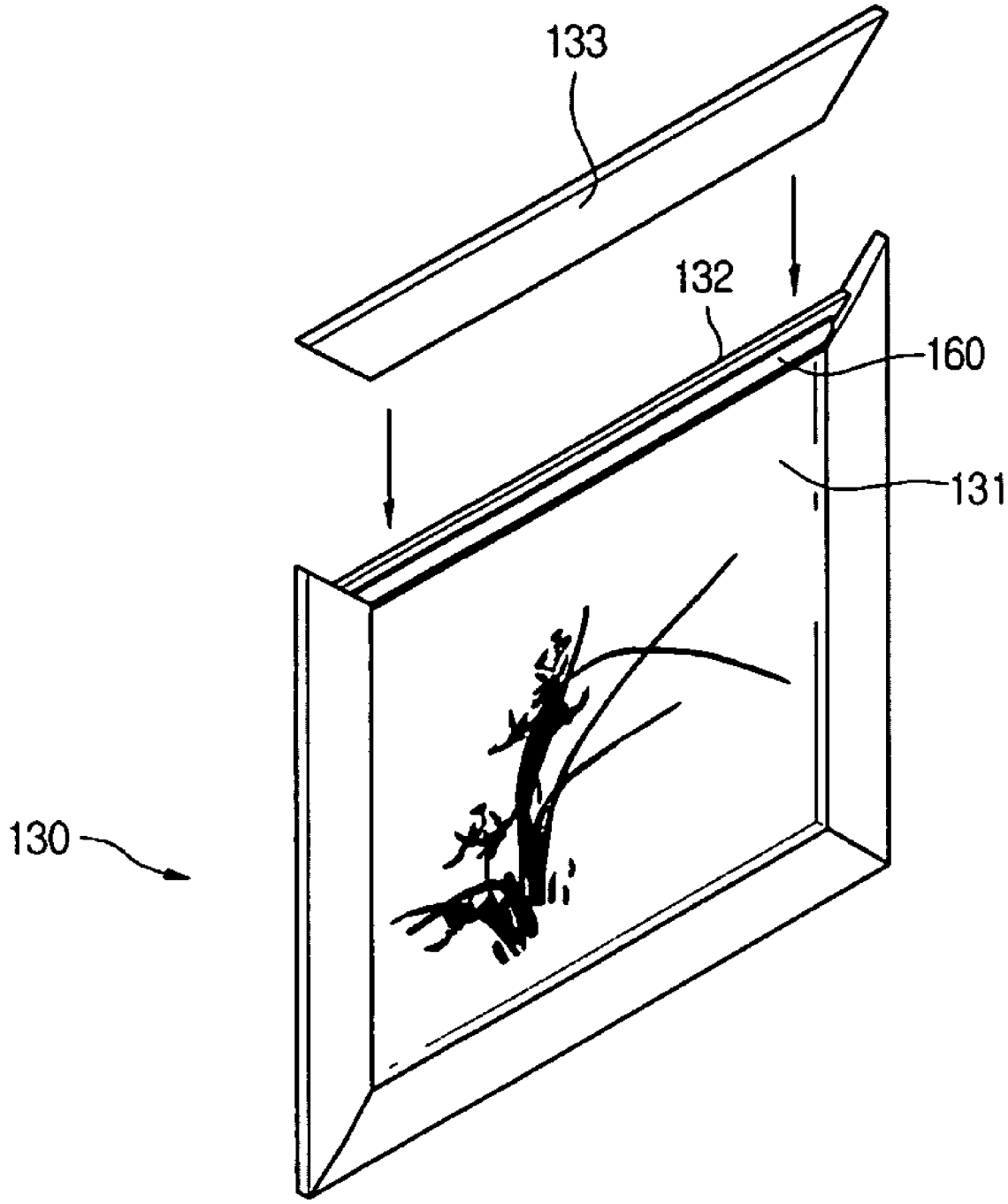
FIG. 8 is a perspective view showing the assembly of the front cover frame edges of the air conditioner indoor unit according to another embodiment of the present invention.

FIG. 8 is a perspective view showing the assembly of the front cover frame edges of the air conditioner indoor unit according to another embodiment of the present invention.

Referring to FIG. 8, the front cover 130 of the indoor unit 100 of the air conditioner according to the present invention allows only one of the four frame edges 133 of the frame to be disassembled.

Specifically, only one of the four frame edges 133 is removed, allowing the window 131, art panel 160, and the back plate 132 to be inserted in the opening created by the removed frame edge 133. After the components 131, 160, and 132 have been inserted, the removed frame edge 133 is reassembled to the frame. With the exception of the bottom edge of the front cover 130, the removable frame edge 133 may be the top edge or the right or left-side edge. Should the bottom frame edge 133 be made to be removable, there is the possibility of a user suffering injury from the bottom frame edge 133 falling due to gravity. This is because structural components of the front cover 130 may detach or dislodge from the front cover 130.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An air conditioner comprising:

a main body;

a front panel movably installed to a front of the main body, so as to form an opening to introduce indoor air;

a discharge vent in said main body separate from said opening;

a front cover disposed at a front of the front panel, and detachably coupled to the front panel; and an art panel interchangeably provided in the front cover, wherein the front cover comprises:

a back cover on which the art panel is placed;

a window made of transparent material disposed at a front of the back cover; and a frame edge for receiving edges of the back cover, the window, and the art panel therein, the frame edge formed by a plurality of pieces, of which at least one is detachable in order to interchange the art panel.

2. The air conditioner according to claim 1, wherein the front panel is coupled to pivot at a predetermined angle or to translate forward and backward from the main body.

3. The air conditioner according to claim 1, wherein the front cover is coupled to the front panel, and pivots at a predetermined angle together with the front panel.

4. The air conditioner according to claim 1, further comprising:

a rack attached to a rear of the front panel for allowing the front panel to pivot at a predetermined angle;

a rotating pinion meshed with teeth on the rack; and a driving motor imparting rotational force to the pinion.

5. The air conditioner according to claim 4, wherein the rack is formed with a predetermined curvature.

6. The air conditioner according to claim 1, further comprising a sub panel movably installed at an inner portion of the front panel, wherein the front cover is attached to a front of the sub panel.

7. The air conditioner according to claim 6, further comprising:

a rack formed at a rear of the sub panel for allowing a forward and backward translation of the sub panel;

a rotating pinion meshed with teeth on the rack; and a driving motor for imparting rotating force to the pinion.

8. The air conditioner according to claim 6, wherein the front cover is capable of forward and backward translation together with the sub panel.

9. The air conditioner according to claim 6, wherein the back cover includes a fastener formed on a rear thereof, and wherein the sub panel or the front panel includes a fastener receptacle formed on the front thereof.

10. The air conditioner according to claim 9, wherein the fastener is a catch, hook, or magnet, and the fastener receptacle is a hole of a predetermined size or a magnet.

11. The air conditioner according to claim 6, wherein the frame edge is formed by a plurality of pieces, of which at least one is detachable.

12. The air conditioner according to claim 9, wherein the frame edge has a groove of a predetermined depth formed along an inside thereof, for inserting edges of the back cover and/or the art panel and/or the window therein.

13. The air conditioner according to claim 9, wherein the frame edge is formed in one unit by coupling individual pieces thereof by means of connectors formed on one end and/or both ends of each individual piece.

14. The air conditioner according to claim 13, wherein the connector is a hooked member or a magnet.

15. The air conditioner according to claim 13, wherein the connector is a corner piece covering outer surfaces of two frame edge pieces at a junction thereof to couple the two frame edge pieces.

16. The air conditioner according to claim 1, further comprising a sub panel disposed at an inner portion of the front panel.

17. The air conditioner according to claim 16, wherein the back cover includes a fastener formed on a rear thereof, and wherein the sub panel or the front panel includes a fastener receptacle formed on the front thereof.

18. The air conditioner according to claim 17, wherein the fastener is a catch, hook, or magnet, and the fastener receptacle is a hole of a predetermined size or a magnet.

19. The air conditioner according to claim 16, wherein the frame edge has a groove of a predetermined depth formed along an inside thereof, for inserting edges of the back cover and/or the art panel and/or the window therein.

* * * * *

UNITED STATES PATENT AND TRADEMARK OFFICE

CERTIFICATE OF CORRECTION

PATENT NO. : 7,607,251 B2
APPLICATION NO. : 11/326396
DATED : October 27, 2009
INVENTOR(S) : Kim et al.

It is certified that error appears in the above-identified patent and that said Letters Patent is hereby corrected as shown below:

On the Title Pg

Item [*] Notice: Subject to any disclaimer, the term of this patent is extended or adjusted under 35 U.S.C. 154(b) by 507 days.

Delete the phrase "by 507 days" and insert -- by 797 days --

Signed and Sealed this

First Day of June, 2010

David J. Kappos

David J. Kappos
*Director of the United States Patent and Trademark Office*